US008413625B2

(12) United States Patent
D'Epiro et al.

(10) Patent No.: US 8,413,625 B2
(45) Date of Patent: Apr. 9, 2013

(54) TRANSMISSION DEVICE BETWEEN TWO CAMSHAFTS OF AN INTERNAL COMBUSTION ENGINE

(75) Inventors: Clino D'Epiro, Turin (IT); Romeo Capodiferro, Turin (IT)

(73) Assignee: Fiat Powertrain Technologies S.p.A., Turin (IT)

( * ) Notice: Subject to any disclaimer, the term of this patent is extended or adjusted under 35 U.S.C. 154(b) by 55 days.

(21) Appl. No.: 13/232,540

(22) Filed: Sep. 14, 2011

(65) Prior Publication Data

US 2012/0073529 A1 Mar. 29, 2012

(30) Foreign Application Priority Data

Sep. 28, 2010 (EP) ..... 10180606

(51) Int. Cl.
*F01L 1/02* (2006.01)

(52) U.S. Cl.
USPC ..... 123/90.31; 123/90.27; 123/195 R

(58) Field of Classification Search ..... 123/90.27, 123/90.29, 90.31, 195 R
See application file for complete search history.

(56) References Cited

U.S. PATENT DOCUMENTS

| | | | | |
|---|---|---|---|---|
| 2,779,321 | A | 1/1957 | Roder | |
| 6,474,288 | B1 * | 11/2002 | Blom | 123/197.2 |
| 2002/0033152 | A1 | 3/2002 | Hara et al. | |

FOREIGN PATENT DOCUMENTS

| | | | |
|---|---|---|---|
| DE | 1033458 | | 7/1958 |
| DE | 3814544 | A1 | 11/1989 |
| DE | 4006945 | A1 | 9/1991 |
| GB | 124042 | A | 3/1919 |
| GB | 216599 | A | 6/1924 |
| GB | 713938 | | 8/1954 |
| JP | 64047904 | | 3/1989 |

OTHER PUBLICATIONS

European Search Report, dated Mar. 2, 2011, for corresponding European application No. 10180606.5, completed on Feb. 23, 2011.

* cited by examiner

*Primary Examiner* — Zelalem Eshete
(74) *Attorney, Agent, or Firm* — Heslin Rothenberg Farley & Mesiti P.C.; Victor A. Cardona, Esq.

(57) ABSTRACT

An internal combustion engine includes a driving shaft, a pair of camshafts for driving engine valves, a transmission connecting the driving shaft to a first of said camshafts and a transmission connecting the first camshaft to the second camshaft. The transmission connecting the two camshafts to each other includes a pair of articulated parallelogram mechanisms each having two crank members rotatable with end portions of the camshafts and connected to each by means of a connecting rod. The crank members are made up of circular discs eccentrically mounted on the camshafts and rotatably received in circular openings formed at the ends of the respective connecting rod. The two crank members rotatable with the same camshaft are spaced from each other by a determined angle.

8 Claims, 6 Drawing Sheets

TRANSMISSION DEVICE BETWEEN TWO CAMSHAFTS OF AN INTERNAL COMBUSTION ENGINE

CROSS REFERENCE TO RELATED APPLICATIONS

This application claims priority from European Patent Application No. 10180606.5 filed on Sep. 28, 2010, the entire disclosure of which is incorporated herein by reference.

BACKGROUND OF THE INVENTION

The present invention refers to internal combustion engines of the type comprising a pair of camshafts for driving engine valves, a transmission connecting the driving shaft to a first of said camshafts and a transmission connecting respective end portions of the two camshafts therebetween.

In the engines of the type indicated above, the transmission connecting the two camshafts may for example be a gear transmission, or a chain transmission, or a toothed belt. The gear transmission practically cannot be used in cases where the distance between the axes of the two camshafts is greater than the limit value, beyond which the overall dimension and weight of the gear transmission exceed the limit. The toothed belt is simple and inexpensive but the life thereof is considerably lower than that of the engine, and of the motor vehicle on which the engine is mounted, hence it implies one or more belt replacement operations during the life of the motor vehicle. The chain transmission, lastly, requires a hydraulic belt tensioning device, which requires additional weight and cost, it is subjected to clearances, it is noisy and also, though lasting longer than a toothed belt it is still subject to limits even from this point of view.

SUMMARY OF THE INVENTION

The object of the present invention is that of providing an internal combustion engine of the previously described type, in which all the drawbacks of the prior art solutions are overcome.

With the aim of attaining such object, the invention is characterized in that said transmission connecting the first camshaft to the second camshaft includes a pair of articulated parallelogram mechanisms each comprising two crank members respectively rotatable with said end portions of the camshafts and connected to each other by means of a connecting rod, in that the abovementioned crank members are made up of circular discs eccentrically mounted on said camshafts and rotatably received in circular openings formed at the ends of the respective connecting rod and in that the two crank members rotatable with the same camshaft are spaced from each other by a predetermined angle.

It should be observed that the application of a mechanism of this type, with two pairs of eccentric discs and two respective connecting rods in an internal combustion engine has been known since long (see for example GB-A-713 938) with reference to the connection transmission between the driving shaft and a camshaft. On the contrary, the use of a transmission of this type for connecting two camshafts to each other is not known. Such application allows obtaining various advantages with respect to mechanisms used up to date for such purpose. With respect to gear transmissions, the transmission according to the invention allows obtaining the connection in a simple and inexpensive manner and requiring minimum space even when the distance between the axes of the two camshafts is relatively extensive. With respect to the solution toothed belt, the system allows obtaining an operational duration actually equal or even longer than the life of the engine and of the motor vehicle on which the engine is mounted. In addition, with respect to the chain solution, the device according to the invention neither requires an auxiliary device nor maintenance operations. It does not generate clearances over the period of operation thereof. Furthermore, the timing adjustment of the camshafts is obtained automatically by assembling the transmission on the camshafts. The system is also much more silent than the chain transmission system. Lastly, it should also be taken into account that the device according to the invention is suitable for obtaining considerable economies of scale in case of production of different models of motor vehicles. The components of the device actually remain unvaried regardless of the distance between the axes of the camshafts, except for the connecting rods that require to be provided according to a corresponding distance. Any other component remains identical for any type of engine.

BRIEF DESCRIPTION OF THE DRAWINGS

Further characteristics and advantages of the invention shall be clear from the description that follows with reference to the attached drawings, purely provided by way of non-limiting example, wherein.

DETAILED DESCRIPTION OF THE INVENTION

Figure 1:
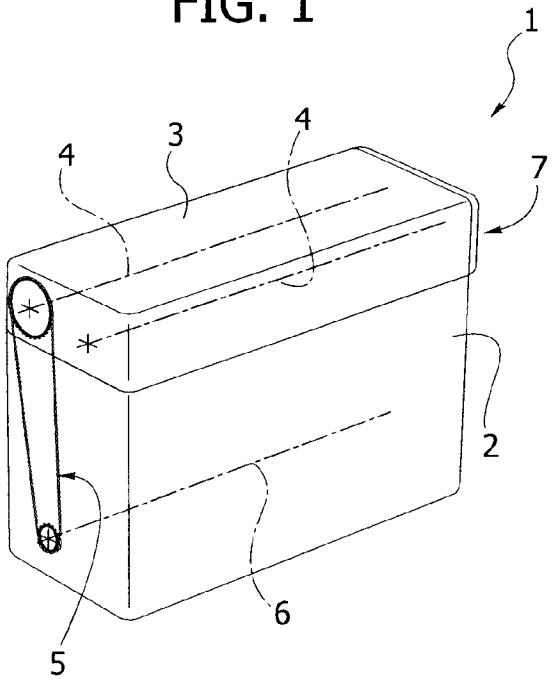
FIG. 1 is a perspective schematic view of an internal combustion engine provided with a transmission according to the present invention.

An internal combustion engine comprising an engine block 2 and a cylinder head 3 into which two rotatable camshafts, of which only the axes 4 are illustrated, intended to control the engine valves are mounted, is schematically indicated in its entirety with number 1 in FIG. 1. The engine comprises a transmission 5 of any known type, for example a chain transmission, arranged at one end of the engine, for connecting respective ends—projecting outside the engine—of one of the two camshafts and the driving shaft rotatably to each other. For the sake of simplicity, FIG. 1 solely shows the axes 6 of the driving shaft.

According to the invention, a transmission 7, whose characteristics are described hereinafter, is provided on the other side of the engine for connecting respective end portions of the two camshafts to each other.

Figure 2:
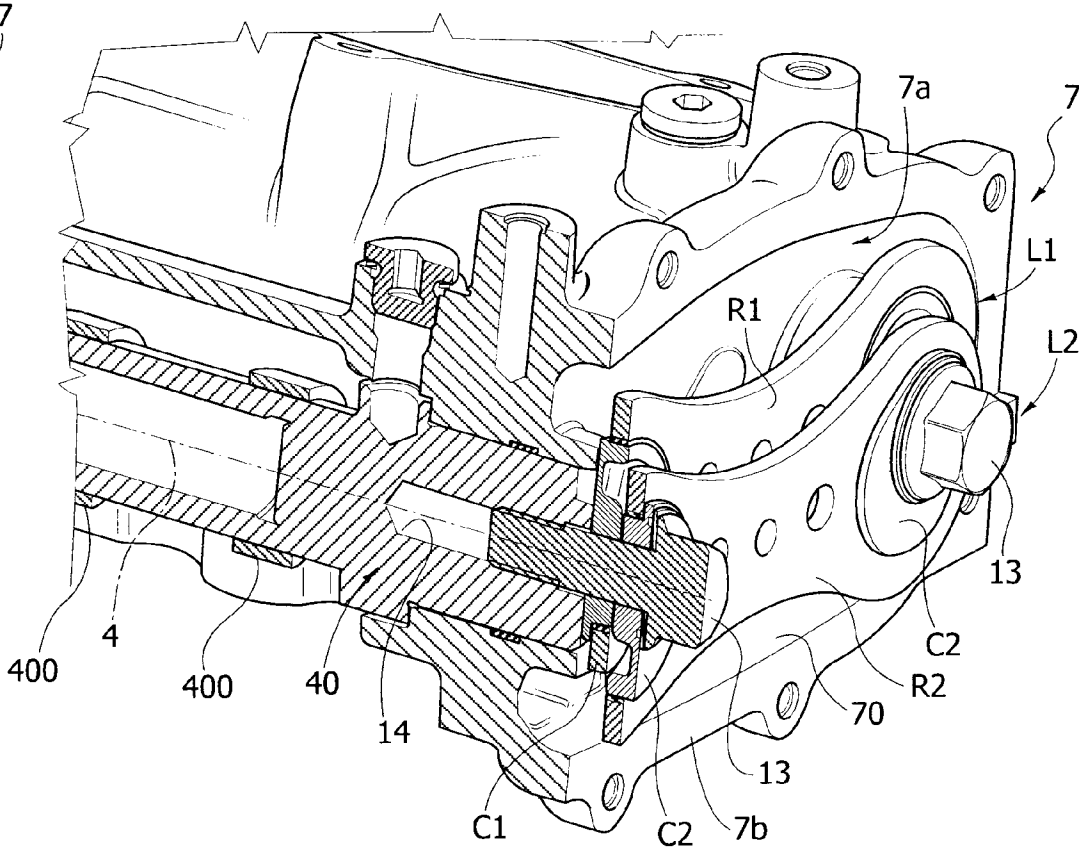
FIG. 2 is a partial schematic and partially sectioned view of a detail of the engine of FIG. 1, with the cover of the transmission removed.

As observable in FIG. 2, which refers to a first embodiment of the transmission 7, such transmission is housed in a casing which is partly 7*a* formed by casting in one piece with the structure of the cylinder head (or a superstructure surmounting the head) on which the camshafts are mounted, and it is partly constituted by a cover (not illustrated) which is coupled and screwed at a peripheral front surface 7*b* of the head (or of the superstructure mounted on the head). In the screwed condition, the cover defines a closed chamber 70 which houses the elements of the transmission and it is filled with oil, through ducts (not illustrated) which place such chamber in communication with the engine lubrication circuit.

Figure 3:
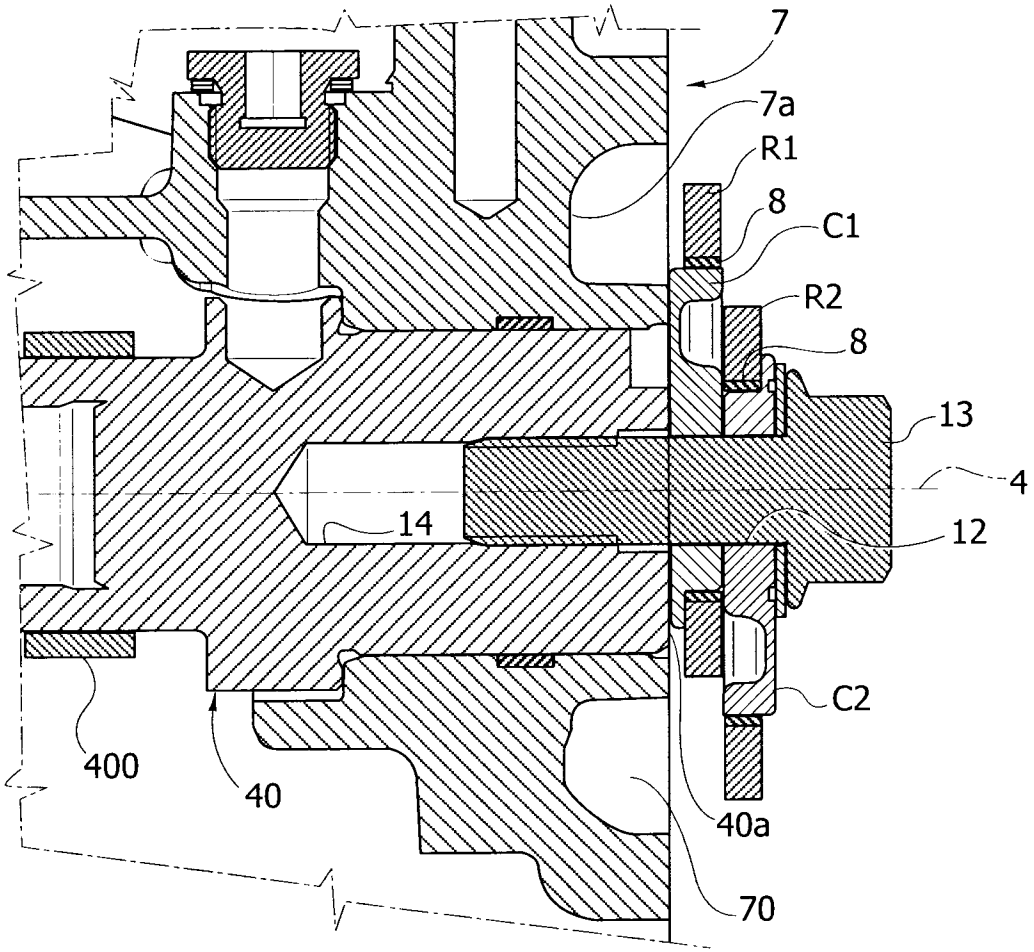
FIG. 3 is sectional view of the detail of FIG. 2.

FIGS. 2, 3 also show—sectionally—one of the two camshafts, indicated with reference number 40, bearing cams 400 and having an end surface 40*a* facing the chamber 70. The same also applies to the other camshaft, not shown in FIGS. 2, 3.

The transmission 7 used for connecting the two camshafts 40 to each other includes a pair of articulated parallelogram mechanisms L1, L2, each of which comprises two crank members C1, C2 respectively rotatable with the two camshafts (40) and connected to each other by means of a connecting rod (respectively indicated with R1 and R2). The two crank members C1, C2 are made up of two circular discs eccentrically mounted on said end surfaces 40*a* of the two camshafts 40. Such discs C1, C2 are rotatably received, with the interposition of respective bushings 8 made of a material with a low friction coefficient (sliding bearings), in circular openings 9 formed at the ends of the connecting rod R1, R2.

Figure 5:
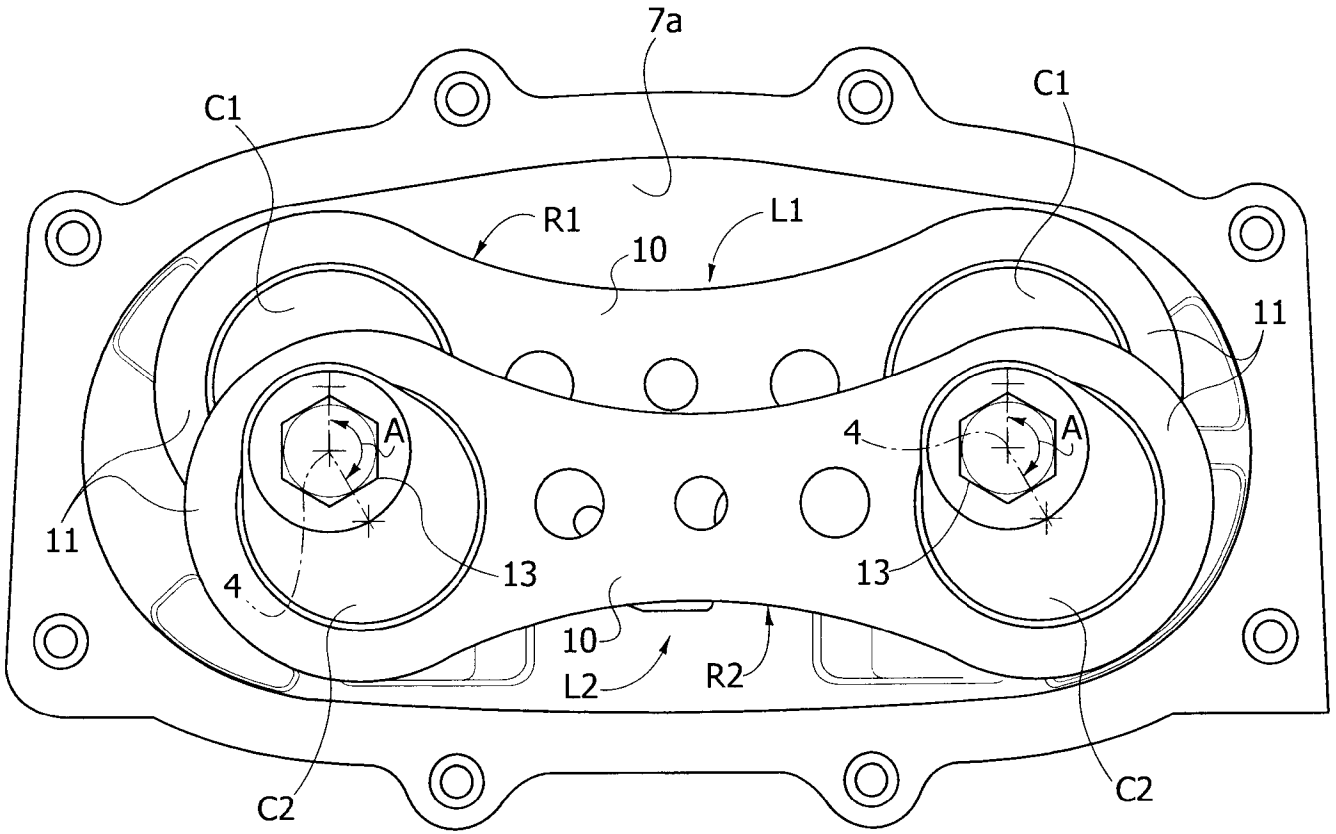
FIG. 5 is a front view of the transmission according to the invention, with the cover removed, like in FIG. 2.

As clearly observable in FIG. 5, the two crank members C1, C2 rotatable with the same camshaft 40 are fixed to such shaft in positions spaced from each other by an angle A, for example by about 120°, with the aim of obtaining a non-labile mechanism.

The two connecting rods R1, R2 are in form of flat metal plates, parallel and adjacent to each other, each having an 8-shaped configuration, with a narrow intermediate portion 10 and two circular-shaped widened end portions 11, in which the circular openings 9 are formed in which the circular discs C1, C2 are rotatably mounted.

Each of the discs C1, C2 has an eccentric circular hole 12 for the engagement of a screw 13 which is screwed into a threaded axial hole 14 formed in the respective camshaft 40 starting from the end surface 40*a*, so as to fix the corresponding discs C1, C2 onto such shaft.

Figure 4:
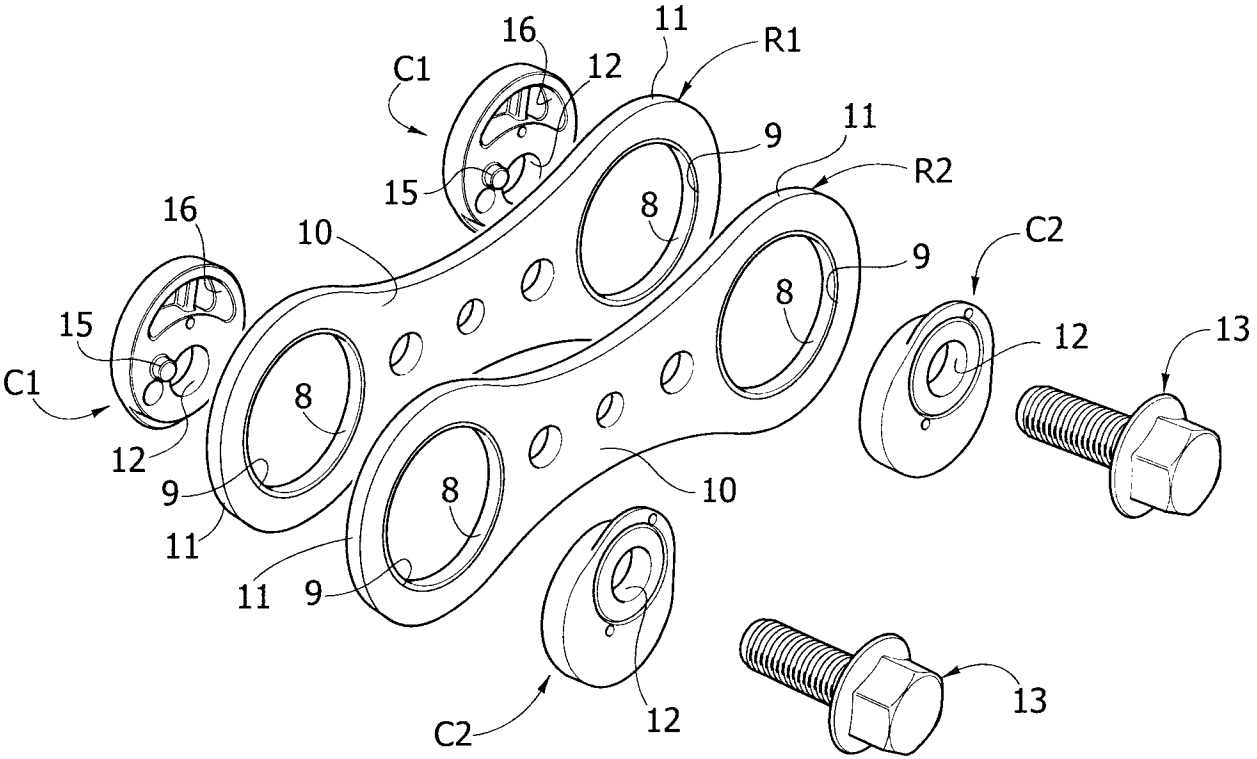
FIG. 4 is an exploded perspective view of the transmission according to the invention.

With reference to FIG. 4, the two discs C1, C2 intended to be fixed to the same camshaft 40 are coupled to each other at the front part. For such purpose, the disc C1 has an eccentric pin 15 which is received in a corresponding cavity (not shown in the drawings) of the surface facing the disc C2. Thus, the two discs C1, C2 fixed to the same shaft 40 are locked at a predetermined angular position, corresponding to the abovementioned angle A. Furthermore, the faces of the discs have a lightening cavity 16.

When assembling, the discs C1, C2 are mounted in respective seats in the connecting rods R1, R2 with the interposition of the bearings 8 and the screws 13 are engaged through the holes 12 of the discs C1, C2 and the holes 14 of the camshafts 40, but without being fastened. In such condition, the operator may verify the correct angular timing adjustment of the camshafts through any known instrument useable for such purpose. When the camshafts are positioned and maintained in the correct angular position, the screws 13 are fastened to make the connection of the two shafts 40 stable.

During the operation of the engine, the rotation of the driving shaft is transmitted to one of the camshafts through the transmission 5, while the rotation from such camshaft to the other camshaft is transmitted through the previously described transmission system.

Figure 6:
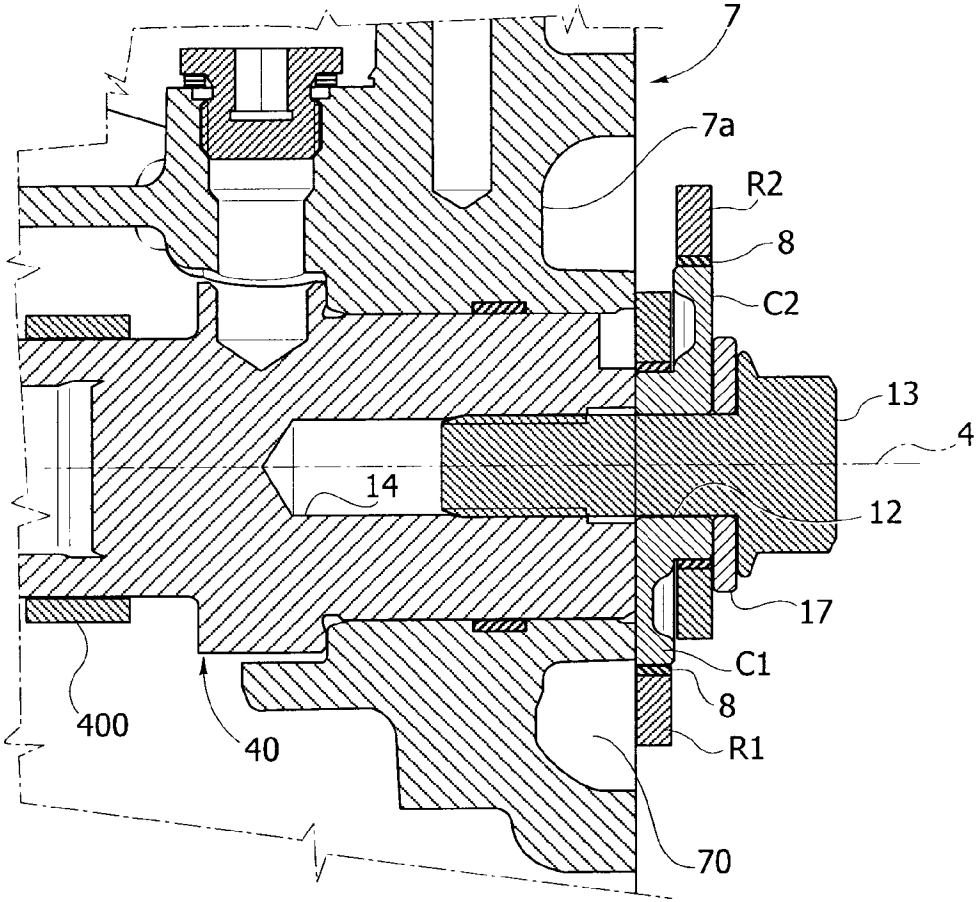
FIG. 6 is a variant of FIG. 3 referring to an alternative embodiment.
Figure 7:
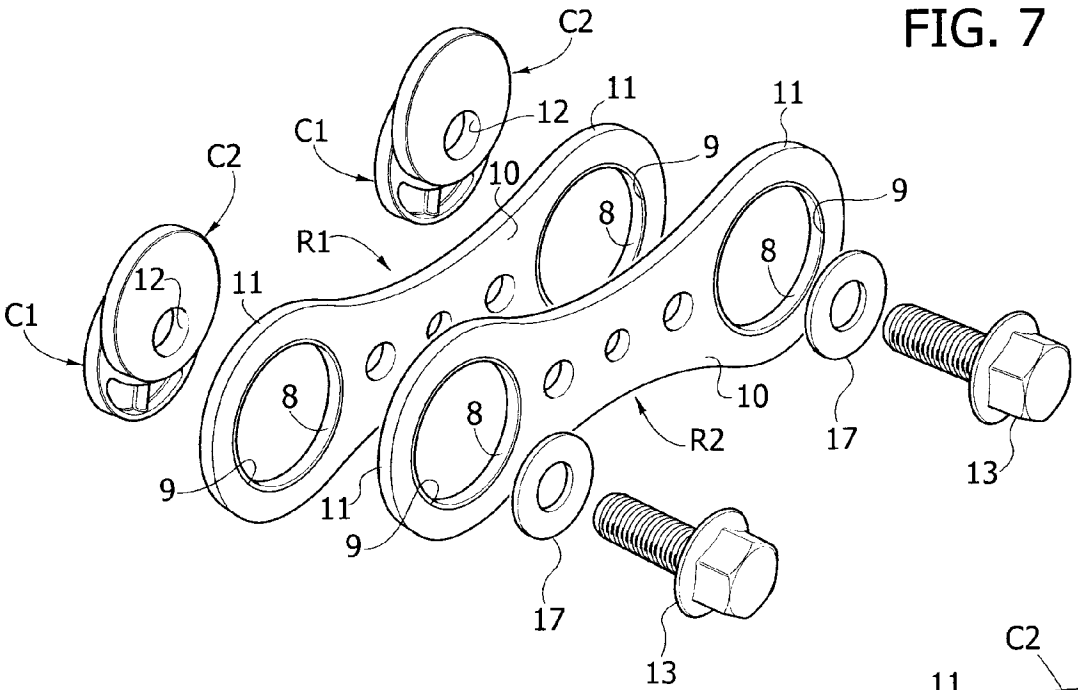
FIG. 7 is an exploded perspective view of the transmission according to the variant of FIG. 6.
Figure 8:
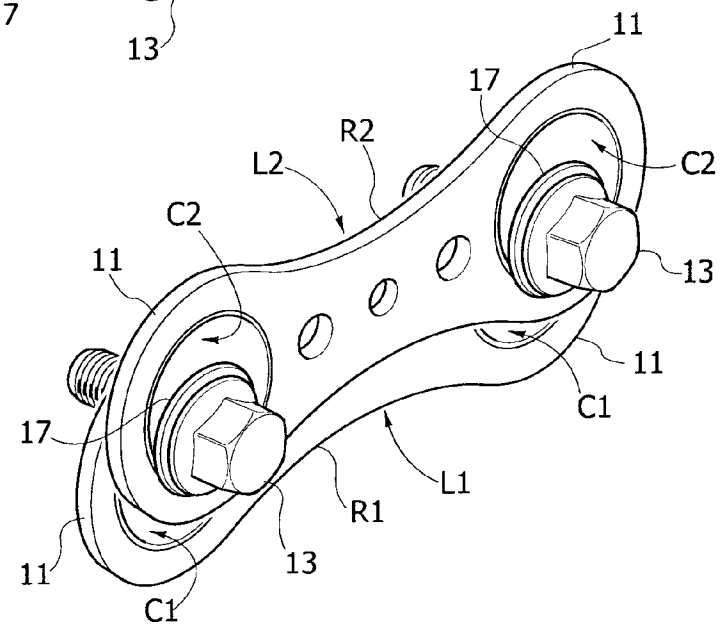
FIG. 8 is a perspective view of the transmission of FIGS. 5, 6.

FIGS. 6-8 illustrate a transmission substantially similar to that of FIGS. 2-5 and for such purpose in such figures the corresponding parts were indicated using the same reference numbers. The sole substantial difference between the second embodiment and the one described previously lies in the fact that in this case the two discs C1, C2 associated to the same camshaft are part of a single piece, for example sintered o forged. Furthermore, FIG. 7 illustrates two washers 17 which are mounted beneath the head of the screws 13.

Naturally, without prejudice to the principle of the invention, the construction details and the embodiments may widely vary with respect to what has been described and illustrated, without departing from the scope of protection of the present invention.

For example, the roller bearings may be used instead of the sliding bearings 8.

What is claimed is:

1. Internal combustion engine, comprising:

a driving shaft, two camshafts for driving engine valves, a transmission connecting the driving shaft to said at least one camshaft, wherein said transmission includes a pair of parallelogram mechanisms, wherein each parallelogram mechanism comprises two crank members connected to each other by connecting rod having its ends articulated to said crank members, wherein the abovementioned crank members of each parallelogram mechanism are made up of circular discs eccentrically mounted on respective shafts and rotatably received in circular openings formed at said ends of the respective connecting rod, wherein the two crank members rotatable with a same shaft are spaced from each other by a predetermined angle, said transmission comprising a first transmission portion connecting the driving shaft to a first one of said camshafts, said first transmission portion being located at one end of said camshafts, said transmission comprising a second transmission portion connecting respective end portions of the two camshafts to each other, said second transmission portion being located at the ends of the camshafts opposite to the camshaft ends where the first transmission portion is located, and said second transmission portion comprising the pair of parallelogram mechanisms, each mechanism of said pair having its two crank members rotatable with said end portions of the camshafts and its connecting rod articulated at its ends to the two crank members.

2. Engine according to claim 1, wherein each connecting rod comprises a substantially 8-shaped plate, with a narrow intermediate portion and two widened end portions each having the abovementioned opening in which the respective eccentric disc is rotatably mounted.

3. Engine according to claim 2, wherein the two eccentric discs associated to the same camshaft are made in a single piece.

4. Engine according to claim 2, wherein the two eccentric discs associated to the same camshaft are made up of two separate elements mutually coupled to each other in a predetermined mutual angular position.

5. Engine according to claim 1, wherein each eccentric disc is rotatably mounted in the respective opening with the interposition of a roller or sliding bearing.

6. Engine according to claim 2, wherein each eccentric disc is rotatably mounted in the respective opening with the interposition of a roller or sliding bearing.

7. Engine according to claim 3, wherein each eccentric disc is rotatably mounted in the respective opening with the interposition of a roller or sliding bearing.

8. Engine according to claim 4, wherein each eccentric disc is rotatably mounted in the respective opening with the interposition of a roller or sliding bearing.

* * * * *